United States Patent [19]

Tripp

[11] 4,013,200

[45] Mar. 22, 1977

[54] DISPENSING CLOSURE

[75] Inventor: Alan R. Tripp, New York, N.Y.

[73] Assignee: Ventura Product Development Corporation, Elmsford, N.Y.

[22] Filed: Oct. 29, 1975

[21] Appl. No.: 626,815

[52] U.S. Cl. ..... 222/534; 222/536

[51] Int. Cl.[2] ..... B65D 25/46

[58] Field of Search ..... 222/533, 534, 536, 537, 222/538

[56] References Cited

UNITED STATES PATENTS

| | | | |
|---|---|---|---|
| 298,338 | 5/1884 | Bean | 222/534 X |
| 507,055 | 10/1893 | Wilson | 222/534 X |
| 3,094,255 | 6/1963 | Hunter | 222/534 X |
| 3,490,659 | 1/1970 | La Vange et al. | 222/534 |

*Primary Examiner*—Robert B. Reeves
*Assistant Examiner*—John P. Shannon
*Attorney, Agent, or Firm*—Howard C. Miskin

[57] ABSTRACT

A bottle screw cap carries a dispensing nozzle member on its top face for swinging about a vertical axis in a recess in the top face between retracted and extended positions in which the discharge end of the nozzle is within and beyond the peripheral edge of the screw cap top, the nozzle proximal end being out of and in registry with a port in the cap communicating with its interior when the nozzle member is in its retracted and extended position respectively. In one form, the top face is oval and includes a vertical tubular post having an outlet port and the nozzle member terminates at its proximal end in a cap rotatably engaging the post. In another form, the top face is circular and the recess is delineated by a chord and the periphery, the shoulder along the chord having a housing recess in which the retracted nozzle member nests.

7 Claims, 9 Drawing Figures

FIG. 6
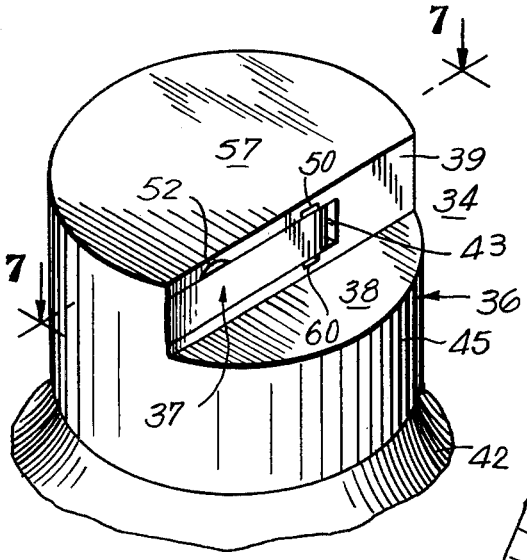
FIG. 7
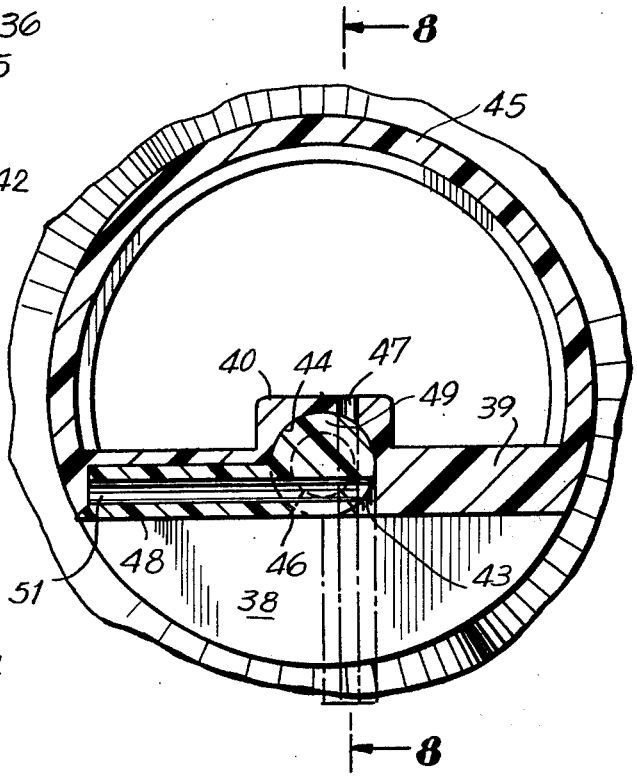
FIG. 9
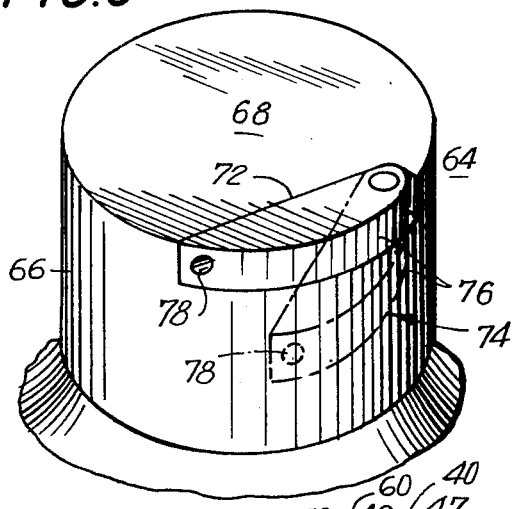
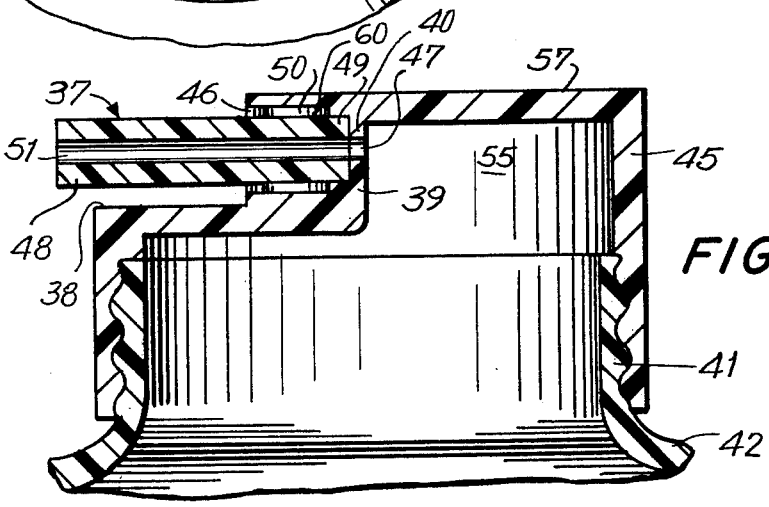
FIG. 8

DISPENSING CLOSURE

BACKGROUND OF THE INVENTION

The present invention relates generally to improvements in liquid dispensing devices and it relates more particularly to an improved closure mounted liquid dispensing nozzle for use with squeeze bottles, gravity discharge bottles and other receptacles.

It is a common expedient to provide the closure cap of a squeeze bottle with a vertical discharge nozzle to facilitate the dispensing and metering of liquid from the bottle. The conventional cap carried nozzle is integrally formed with the cap and is initially closed to permit the transport, storage and vending of the bottled product and is opened by severing the top of the nozzle which then remains open. This arrangement possesses numerous drawbacks and disadvantages since the contents of the bottle, once the nozzle is opened and used, is exposed to the ambient atmosphere with its undesirable effects on the packaged liquid. Many arrangements have been proposed in which the nozzle may be selectively opened and closed but these have been unreliable, complicated, expensive, or awkward devices, the nozzle is upwardly directed when open so that the device is inconvenient and difficult to use and of little versatility and adaptability and otherwise leaving much to be desired.

SUMMARY OF THE INVENTION

It is a principal object of the present invention to provide an improved liquid dispensing device.

Another object of the present invention is to provide an improved closure mounted dispensing nozzle for use with squeeze bottles, gravity discharge bottles and other liquid containers.

Still another object of the present invention is to provide an improved bottle closure screw cap mounted liquid dispensing nozzle in which the nozzle dispenses liquid or foam in a generally horizontal direction and is transferable between open and closed conditions and concurrently movable to extended and retracted positions respectively.

Another object of the present invention is to provide a selectively extendable and operable nozzle device in which the nozzle, in open condition, extends generally horizontally.

A further object of the present invention is to provide a dispensing nozzle device of the above nature, characterized by its reliability, ruggedness, simplicity, low cost, ease and convenience of use and great versatility and adaptability.

The above and other objects of the present invention will become apparent from a reading of the following description taken in conjunction with the accompanying drawings which illustrate preferred emodiments thereof.

In a sense, the present invention contemplates the provision of a dispensing nozzle device comprising a closure defining body member attachable to the discharge opening of a receptacle, such as a squeeze or other bottle or the like, so that an interior face of the body member is exposed to the interior of the receptacle, the body member, including a horizontal top section having a recess formed therein extending to the periphery of the top section, a tubular nozzle member having a first port defining opening at its proximal end and a discharge opening at its distal end, and means pivotally supporting the nozzle member for swinging in a horizontal plane in the recess about a vertical axis at the proximal end of the nozzle member between a retracted first position and an extended second position, the body member having a second port lying in the path of the first port and communicating with the body member interior face and the ports being out of registry and in registry respectively when the nozzle member is in its first and second positions.

In the preferred form of the improved device, the closure member is a screw cap with an oval top face and has a central vertical hollow post having the second post in its peripheral wall. The closure member top section is oval and the recess is a quadrant sector thereof delineated by shoulders along the major and minor axes. The nozzle member terminates at its inner end in a cap which rotatably engages and is retained on the post and thus caps it, and in the nozzle member closed position, the nozzle member extends along the top section major axis to the periphery thereof. In another form the top section is circular and the recess is delineated by a vertical shoulder extending along a chord to the periphery of the top section and the nozzle member is swingable about a medial vertical axis inwardly of the shoulder between an extended port registering position horizontally perpendicular to the shoulder and a retracted port closed condition with the nozzle member nesting in a recess in the shoulder.

The improved nozzle structure is highly reliable, rugged, of great simplicity being formed of only two molded parts and easy and convenient to use.

BRIEF DESCRIPTION OF THE DRAWINGS

FIG. 6 is a fragmentary perspective view of another embodiment of the present invention with the nozzle shown in retracted position;

FIG. 7 is a sectional view taken along line 7—7 in FIG. 6; and

FIG. 8 is a sectional view taken along line 8—8 in FIG. 7, with the nozzle member shown in extended position.

FIG. 9 is a fragmentary prospective view of another embodiment with the nozzle shown in the retracted position.

Figure 1:
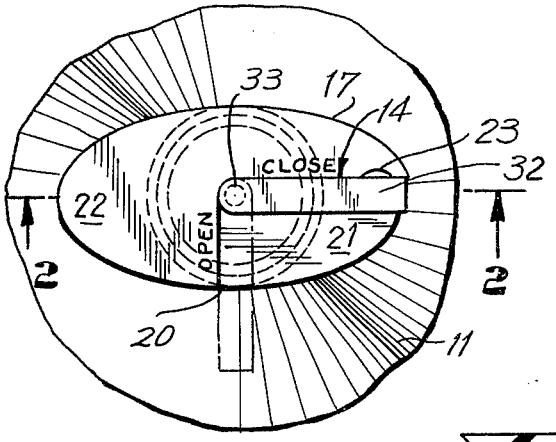
FIG. 1 is a fragmentary top plan view of a bottle provided with the closure mounted nozzle according to the present invention, the nozzle being shown in retracted position.

Referring now to the drawings, particularly FIGS. 1 to 5 thereof, which illustrates a preferred embodiment of the present invention, the reference numerical 10 generally designates the improved dispensing closure device which is shown applied to a liquid containing bottle 11. Although the bottle 11 is advantageously a squeeze type bottle and is formed of a resilient polymeric resin, such as polyethylene polypropylene, polyvinyl chloride and the like, it may be another type of receptacle and formed of other materials. The bottle 11 is of conventional construction and includes an upwardly directed, externally threaded neck portion 12 and is integrally formed by blow molding or the like.

The closure device 10 comprises a cap type closure defining body member 13 and a nozzle member 14, both members being formed of a relatively rigid synthetic polymeric resin material, such as polypropylene or polyvinylchloride by injection molding or other known process. The body member 13 is an integrally formed unit and includes a bottom section or skirt wall 16 which is internally threaded to mate the externally threaded neck 12 which it tightly releasably engages. The upper section 17 of the body member 13 is of oval or elliptical horizontal cross section and the peripheral face of lower section 16 joins the top face of upper section 17 by an outwardly upwardly flaring peripheral face.

The top of upper section 17 is cut out in a quadrant thereof to form a recess 18 delineated by a vertical shoulder 19 slightly outwardly of and parallel to the major axis of upper section 17, a vertical shoulder 20 perpendicular to shoulder 19 and slightly outwardly of and parallel to the minor axis of upper section 17 and a horizontal oval quadrant shaped base 21 downwardly offset from the remaining top face 22 of upper section 17. A fingernail accommodating notch 23 is formed in the outer upper edge of shoulder 19.

Formed on the recess base 21, coaxially with the body member 13 and spaced from the corner of shoulders 19 and 20 is an upwardly directed vertical tubular post 24 whose bore 26 communicates with the bottom interior face 27 of the top upper section 17, and hence with the interior of bottle 11. One or more peripherally spaced projections 28, or a peripheral ridge, is formed on the outer face of post 24 shortly above the base thereof. Also formed in the peripheral wall of post 24 a short distance below its top is a circular outlet port 29 which is directed along the minor axis of body member top section 17.

The nozzle member 14 includes an elongated tubular body member 32 terminating at its inner end and communicating with an open bottom cylindrical cap 33 rotatably engaging the post 24 to permit the horizontal swinging of the nozzle member 14 between positions abutting shoulders 19 and 20. The top wall of cap 33 rests on the top of post 24 and its inner peripheral face 34 engages the post outer peripheral face, the inner peripheral face 34 of the rotatable coupling cap 33 having a peripheral groove formed therein which peripherally, slidably engages the projections 28.

The nozzle member 32 is of such length that when it is in its first or closed position abutting the shoulder 19, the distal or outer end thereof reaches to about the outer top peripheral edge of the body member 13 and when it is in its second or open position abutting the shoulder 20 the distal end thereof projects beyond the body member upper periphery. Furthermore, when the nozzle member 14 is in its first position, the nozzle member bore is out of registry with the part 29 so that there is no communication between the bottle interior and the nozzle member 14 and when the nozzle member 32 is in its second position the nozzle port registers with the part 29 and communicates there through with the bottle interior and the fluid contained therein.

Figure 2:
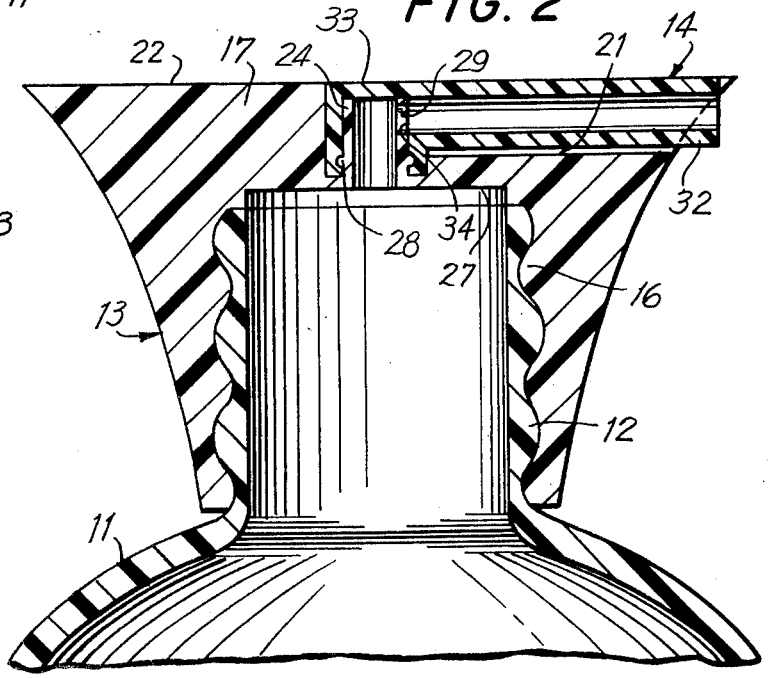
FIG. 2 is an enlarged sectional view taken along line 2—2 in FIG. 1.
Figure 3:
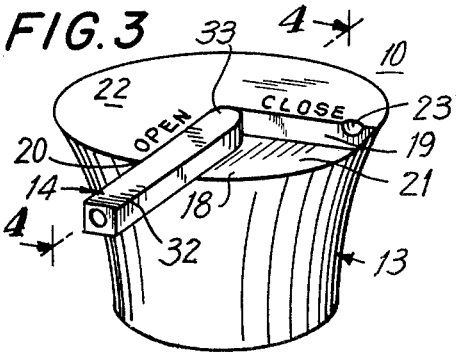
FIG. 3 is a perspective view of the nozzle bearing closure member with the nozzle member shown in extended operable position.
Figure 4:
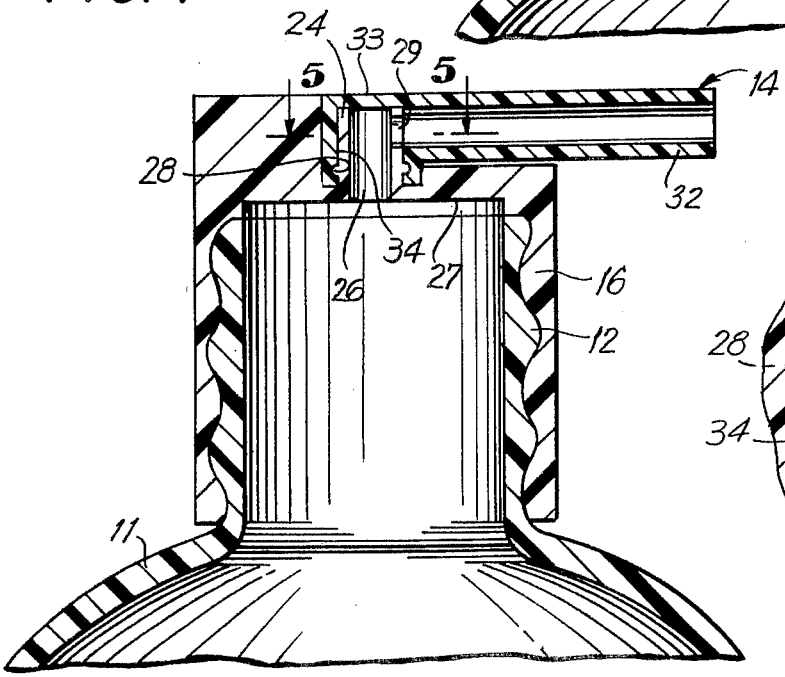
FIG. 4 is an enlarged sectional view taken along line 4—4 in FIG. 3.
Figure 5:
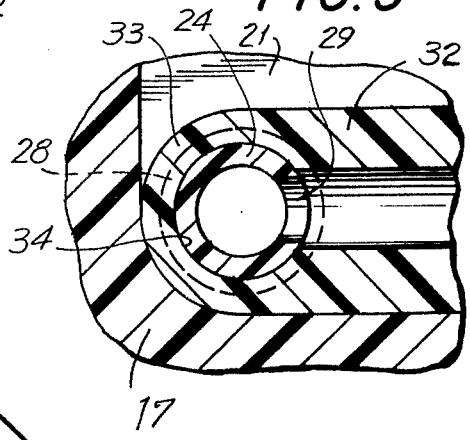
FIG. 5 is an enlarged sectional view taken along line 5—5 in FIG. 4.

The operation and application of the dispensing device 10 attached to the bottle 11 is clear from the above description. Merely by swinging the nozzle member from its retracted position, as shown in FIG. 1, 90° to the stop defining shoulder 20, as shown in FIG. 2, the nozzle member 32 is extended and the outlet port 29 opened permitting the dispensing of liquid through the nozzle by squeezing the bottle. To close the valve port 29, the nozzle member 14 is merely swung to its retracted position abutting shoulder 19. It should be noted that the bottle contents may be discharged directly through the dispensing nozzle or may be transmitted through a foaming device or other mechanism prior to discharge.

In FIGS. 6 to 8 of the drawings, there is illustrated another embodiment of the invention which differs from that first described primarily in the configuration of the body member and the association of the nozzle member therewith. Specifically, the modified nozzle device 34 comprises a circular cylindrical closure member cap shaped body member 36 including a stepped circular top having a large raised horizontal top face 57 and a small depressed lower top face 38 separated by a vertical shoulder wall 39 having a medial vertical central enlargement or rib 40 on its inner face, the shoulder wall 39 extending along a chord of the body member top wall. Depending from the periphery of the body member top wall is a cylindrical skirt wall 45 which is internally threaded to engage the externally threaded neck 41 of a bottle 42. A rectangular recess or groove 43 is medially formed in the front face of shoulder wall 39 and extends from about the midpoint of the shoulder wall 39 to a point short of the outer face of skirt wall 45. A vertical cylindrical recess 44 is formed in the inner vertical face of groove 43 medially positioned relative to enlargement 40 and a pair of circular journal wells 60 coaxial with cylindrical recess 44 are formed in the top and bottom faces of groove 43 and communicate with the outside face of shoulder wall 39 by restricted throats 46. An outlet defining port bore 47 is formed in the enlargement 40 and communicates with recess 44 at a point laterally offset from the medial axis thereof.

The nozzle member 37 includes a square tubular body member 48 completely nestable in groove 43 and terminating at its inner end a rearwardly offset vertical cylindrical head 49 rotatably engaging the cylindrical recess 44. Integrally formed with head 49 and coaxial therewith and a pair of upper and lower journal walls 60 to support the nozzle member 37 for swinging between a valve closed retracted position fully nesting in recess 43, as shown in FIGS. 6 and 7 and a valve open extended position projecting radially beyond the edge of the body member 36. The body member 48 has a longitudinal bore 51 extending for the full length thereof and having a port defining opening at its inner end which registers with the port 47 when the nozzle member 37 is in its extended position as shown in FIG. 8. When the nozzle member is in its retracted position the nozzle member and body member ports are out of registry. A fingernail notch 52 is shown in FIG. 6 in wall 39 to aid in moving nozzle 37 away from wall 39.

However, nozzle body member 48 can be lengthened slightly to just extend beyond the periphery of body 36 to allow swinging the nozzle and eliminate the notch 23. Also the chamber 55 formed by the depressed lower face 38 and wall 39 allow the nozzle 37 to be offset from the center axis of the container, but yet allow straight flow of the liquid or foam within the container through nozzle base 51.

In FIG. 9 of the drawing is illustrated another embodiment of the invention which differs from that described in FIGS. 6–8 primarily in the configuration of the nozzle and the body member having a lesser recess, specifically device 64 has a circular cylindrical closure cap shaped body 66 including a circular top 68 and a small depressed lower face 70 separated by a vertical shoulder wall 72 having a medial enlargement not shown. The nozzle 74 includes body member 76 which is nestable on lower face 70 with a peripheral surface 78 corresponding to the peripheral surface of body 66 to form a smooth curved surface in closed position. Nozzle 74 has a pair of lugs on opposite sides singular to nozzle 37 for being pivotally supported and adapted to swinging between a valve-closed retracted position fully nesting on lower face 70 and a valve-open extended position projecting radically beyond the edge of body member 66. Nozzle body member 76 has a bore extending straight along its length and terminating at opening 78 at its extremity. The nozzle 74 has a port, which selectively engages a mating port of body member 66 not shown, when nozzle 74 is in its extended position, and when the nozzle member is in its retracted position, the nozzle and body member parts are out of registry.

The operation and application of this embodiment are similar to those described above.

While there have been described and illustrated preferred embodiments of the present invention, it is apparent that numerous alterations, omissions and additions may be made without departing from the spirit thereof. While the recess within which the nozzle swings is shown to be about 90°, a smaller or larger arc may be used.

What is claimed is:

1. A dispensing nozzle device comprising a closure defining body member attachable to the discharge opening of a receptacle so that an interior face of said body member is exposed to the interior of said receptacle, said body member including an oval top face having a quadrant recess formed therein extending to the periphery of said top face and delineated by vertical shoulders extending along the major and minor axes of said top face, a longitudinally extending tubular nozzle member having a first port at its proximal end and a discharge opening at its distal end, and means pivotally supporting said nozzle member for swinging in a horizontal plane in said recess about a vertical axis at the proximal end of said nozzle member and at the center of said top face at a point proximate the juncture of said shoulders between a retracted first position and an extended second position, said body member having a second port formed therein lying in the path of said first port and communicating with said body member interior face and said ports being out of registry and in registry when said nozzle member is in its first and second position respectively, and the distal end of said nozzle member lying within the periphery and projecting beyond the periphery of said body member when said nozzle member is respectively in its first and second positions.

2. The dispensing nozzle device of claim 1 wherein said nozzle member when in said first position lies in the direction of the major axis of said top face.

3. The dispensing nozzle device of claim 1 wherein said pivotal support means comprises a vertical hollow cylindrical post integrally formed with said body member and communicating with said interior face thereof and having said second port formed in its peripheral wall, said nozzle member terminating at its proximal end in a cap portion rotatably engaging said post and communicating with said first post and comprising means retaining said cap on said post.

4. The dispensing nozzle device of claim 1 wherein said body member comprises a screw cap including a top wall provided with said top face and an internally threaded depending skirt wall.

5. A dispensing nozzle device comprising a closure defining body member attachable to the discharge opening of a receptacle so that an interior face of said body member is exposed to the interior of said receptacle, said body member including a circular top face having a recess formed therein extending to the periphery of said top face, a longitudinally extending tubular nozzle member having a first port at its proximal end and a discharge opening at its distal end, and means pivotally supporting said nozzle member for swinging in a horizontal plane in said recess about a vertical axis at the proximal end of said nozzle member between a retracted first position and an extended second position, said body member having a second port formed therein lying in the path of said first port and communicating with said body member interior face and said ports being out of registry and in registry when said nozzle member is in its first and second positions respectively, said recess being delineated by a vertical shoulder extending along a chord of said top face and the periphery of said body member, said shoulder having a longitudinally extending second recess formed therein, said nozzle member being swingable about a vertical axis eccentric to the center of said top face and in said second recess inwardly of the outer end thereof between said first position nested in said second recess disposed within the periphery of said body member and said second position projecting beyond the periphery of said body member.

6. The dispensing nozzle device of claim 5 wherein said second port is formed in the base of said second recess.

7. A dispensing nozzle device comprising a closure defining body member attachable to the discharge opening of a receptacle so that an interior face of said body member is exposed to the interior of said receptacle, said body member including a top face having a generally oval configuration and periphery with a major and minor axis, a longitudinally extending tubular nozzle member having a first port at its proximal end and a discharge opening at its distal end, means pivotally supporting said nozzle member for swinging in a horizontal plane on said top face about a vertical axis at the proximal end of said nozzle member between a retracted first position and an extended second position, said pivotal support means including a vertical hollow cylindrical post integrally formed with said body member and communicating with said interior face thereof and having a second port formed in its peripheral wall, said nozzle member terminating at its proximal end in a cap portion rotatably and sealably engaging said post and communicating with said first post and comprising means retaining said cap on said post, and said ports being out of registry and in registry when said nozzle member is in its first and second positions respectively, said distal end of said nozzle member lies within the periphery and projects beyond the periphery of said body member when said nozzle member is respectively in its first and second positions.

* * * * *